US009162409B2

(12) United States Patent
Hülshorst

(10) Patent No.: US 9,162,409 B2
(45) Date of Patent: Oct. 20, 2015

(54) SCREW PRESS

(71) Applicant: Johannes Hülshorst, Verl (DE)

(72) Inventor: Johannes Hülshorst, Verl (DE)

( * ) Notice: Subject to any disclaimer, the term of this patent is extended or adjusted under 35 U.S.C. 154(b) by 347 days.

(21) Appl. No.: 13/674,984

(22) Filed: Nov. 13, 2012

(65) Prior Publication Data

US 2013/0247783 A1 Sep. 26, 2013

(30) Foreign Application Priority Data

Nov. 14, 2011 (DE) ..... 10 2011 118 369

(51) Int. Cl.
*B30B 1/18* (2006.01)
*B30B 15/00* (2006.01)

(52) U.S. Cl.
CPC . *B30B 1/186* (2013.01); *B30B 1/18* (2013.01); *B30B 15/0088* (2013.01)

(58) Field of Classification Search
CPC ..... B30B 1/18; B30B 1/181; B30B 1/186; B30B 15/0088
USPC ..... 100/287, 289, 290; 72/454
See application file for complete search history.

(56) References Cited

U.S. PATENT DOCUMENTS

| | | | | |
|---|---|---|---|---|
| 3,687,070 | A * | 8/1972 | Dischler | 100/271 |
| 3,817,352 | A * | 6/1974 | Bourgeois et al. | 184/5 |
| 2005/0050723 | A1 * | 3/2005 | Hauser et al. | 29/732 |
| 2007/0068399 | A1 * | 3/2007 | Anderson et al. | 100/269.06 |

FOREIGN PATENT DOCUMENTS

| | | |
|---|---|---|
| DE | 201 08 706 | 9/2001 |
| DE | 20 2005 013 002 | 1/2006 |
| DE | 20 2011 002 788 | 5/2011 |
| DE | 20 2011 004 317 | 7/2011 |

* cited by examiner

*Primary Examiner* — Jimmy T Nguyen
(74) *Attorney, Agent, or Firm* — Cozen O'Connor

(57) ABSTRACT

A screw press includes a drive with at least one spindle nut which is vertically adjustable at a threaded spindle and to which is fastened an upper press part or the like. A guide column is connected at the underside of the upper press part at one end, and the guide column is loaded in tension by the drive during the pressing process.

9 Claims, 2 Drawing Sheets

SCREW PRESS

BACKGROUND OF THE INVENTION

1. Field of the Invention

The invention is directed to a screw press having a drive with at least one spindle nut which is vertically adjustable at a threaded spindle and to which is fastened an upper press part, a ram or the like.

2. Detailed Description of the Prior Art

Along with hydraulic presses, mechanical screw presses are widely used and are known in a great variety of constructional forms. The operating principle of the screw press has remained unchanged over the ages. A screw or threaded spindle which is usually arranged perpendicular to a press table is set in rotation by a drive, thereby raising a spindle nut that can be fixed in relation to the press table in a variety of ways. DE 201 08 706 U1 discloses a screw press in which a ram is fixed to a housing-fixed spindle nut. In this embodiment form, the tubular ram in coaxial arrangement overlaps a free end of the threaded spindle which, at the other end above a press table, is set in rotation by an electric drive.

Other constructional forms of screw presses are described in DE 20 2005 013 002 U1, DE 20 2011 004 317 U1 and DE 20 2011 002 788 U1. In these generic screw presses, an upper press part is moved relative to a press table. Because a process of this kind must be carried out in a very exact manner, e.g. four drive-independent column-like guides are provided in these screw presses between the press table and the upper press part. The drive of at least two, usually four, threaded spindles is arranged in or under the press table. The spindle nuts which are vertically adjustable on the threaded spindles are fixed to the upper press part, and the threaded rods penetrate the upper press part at a slight height thereof above the press table.

In presses of this kind having an upper press part moving along guides, a further problem consists in accurately identifying the pressing force during a pressing process.

When a load cell which senses the threaded spindle coaxially and provides exact values is provided between the spindle nuts in the screw press according to DE 201 08 706 U1, transducers are arranged in or on the press table in the generic presses under discussion; the readings of these transducers have limited meaning when the press table is loaded asymmetrically.

SUMMARY OF THE INVENTION

With this set of technical problems as a point of departure, the invention has the object of providing a screw press of the type mentioned above which is constructed in an extremely compact manner, does away with separate guides for the upper press part, and in which the occurring pressing forces can be exactly detected.

In a screw press having a drive with at least one spindle nut which is vertically adjustable at a threaded spindle and to which an upper press part or the like is fixed, the above-stated problem is solved according to claim 1 in that a guide column is connected at the underside of the upper press part at one end, and in that the guide column is loaded in tension by the drive during the pressing process.

In the screw press according to the invention, the guide columns which preferably have a circular cross section take on the function of introducing force into the upper press part in a well-defined manner on the one hand and also guiding the upper press part by means of a corresponding bearing support during a pressing process on the other hand so that separately constructed guides can be dispensed with.

Owing to this step, the drive is to be provided in or under a press table. Accordingly, for transmission of force by the drive to the upper press part, it is further provided that the guide column has a central core bore hole whose diameter is dimensioned so as to be greater than that of the threaded spindle, that the axial length of the guide column corresponds at least to the stroke of the screw press, and that the spindle nut penetrated by the threaded spindle is fixed at the other end to the guide column coaxial to the core bore hole.

As a result of this step, it is ensured over the entire stroke of the screw press that the threaded spindle is captive inside the guide column at the upper side of the press table and does not project beyond the upper press part at the upper side.

Further, the threaded spindle preferably penetrates the press table in a recess so as to be driven below the press table. Due to the coaxial arrangement of the threaded spindle and core bore hole in the guide column, this recess must also be sufficiently dimensioned for the outer cross section of the guide column.

Alternatively, this kind of arrangement of guide column and threaded spindle can also be guided past the press table.

This does not affect the step whereby the guide column is captive in a guide at a press table. This preferably relates to a plain bearing which is arranged on the press table as guide, and therefore the guide with threaded spindle penetrates a corresponding recess under the plain bearing in the press table.

Conveniently, it can be provided that the spindle nut is fixed in a bore hole at the other end in the guide column. In a further embodiment, it can be provided that the spindle nut is provided with a radially projecting collar. Accordingly, when the spindle nut is introduced into the bore hole, an exact positioning of the spindle nut is ensured by axial contact of the collar on the mouth of the bore hole.

In a further preferred embodiment form, the spindle nut is arranged in its entirety inside the guide column. Therefore, the outer surface of the guide column is not impaired by projections, bore holes or the like but, rather, remains smooth and can therefore be guided very accurately in a guide or in a plain bearing.

In an embodiment of the screw press according to the invention, it is further provided that an axial lubrication bore is arranged in the guide column, that a blind bore hole is introduced into the spindle nut axially adjoining the latter, and that the axial blind bore hole is crossed by a radial lubrication bore in the spindle nut. In this way, lubrication is ensured over the entire actuating path of the spindle nut on the one hand and the outer surface of the guide column remains unimpaired in its entirety.

The design of the screw press according to the invention further allows the pressing pressure to be measured in a comparatively simple manner because the introduction of force into the upper press part is carried out in a well-defined manner via the guide columns. For a measurement of this kind, the guide column preferably has an outer annular groove on the upper press part side, and a force transducer, for example, a strain gauge, is arranged in the annular groove and preferably does not project radially beyond the annular groove. In so doing, it can be further provided that a flange is formed by the annular groove for fixing the guide column to the upper press part. The fastening can be carried out, for example, by means of screws which engage in annularly arranged threaded holes in the flange.

BRIEF DESCRIPTION OF THE DRAWINGS

The screw press according to the invention will be described more fully referring to the drawings in which an embodiment example is shown only schematically and not to scale. The drawings show.

DETAILED DESCRIPTION OF THE PRESENTLY PREFERRED EMBODIMENTS

Figure 1:
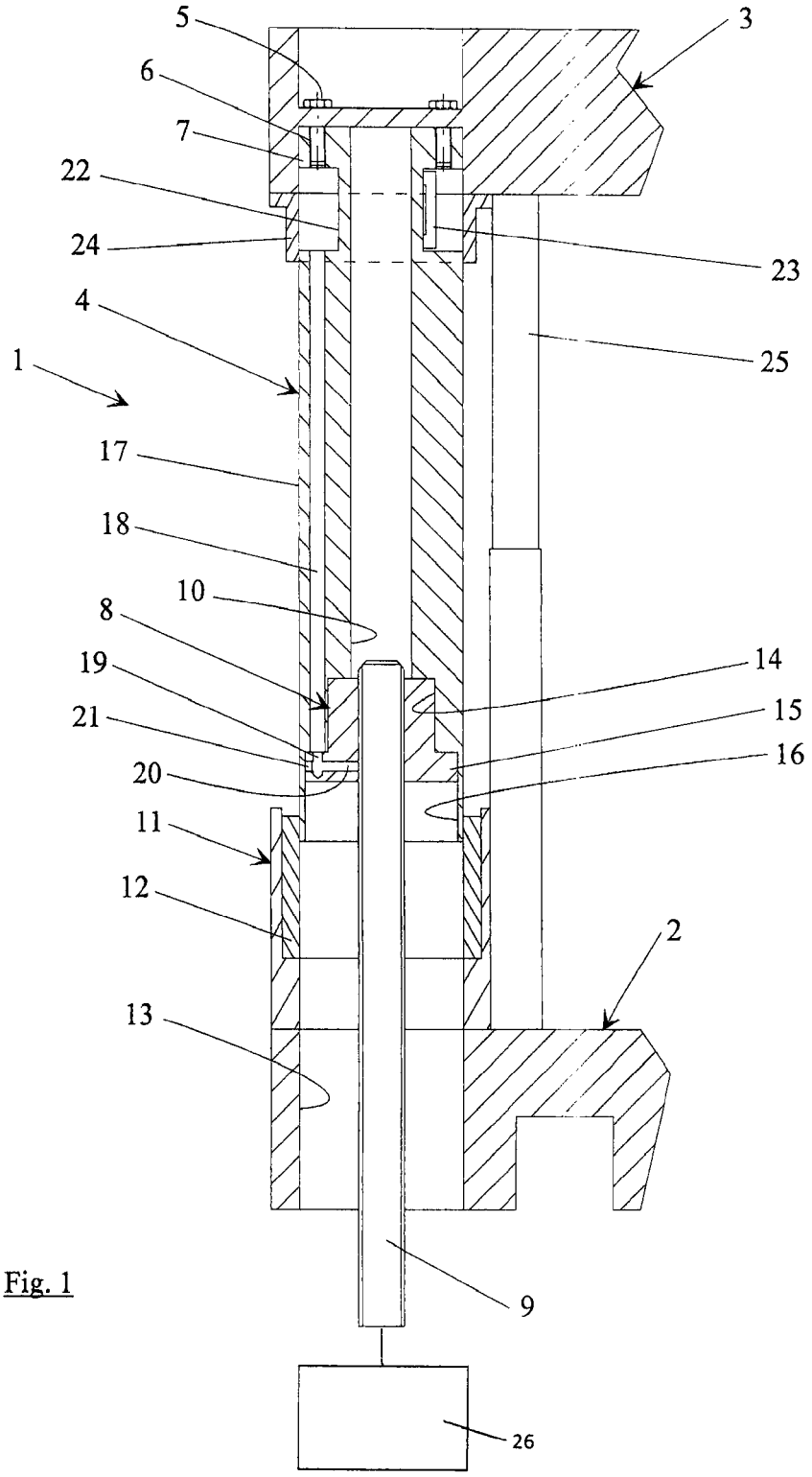
FIG. 1 a vertical section through an upper press part, a guide column and a press table with the upper press part in an upper position.

The screw press 1 shown in the drawings has an upper press part 3 which is vertically adjustable over a press table 2. Both press table 2 and upper press part 3, which usually have a rectangular footprint, are conventionally arranged in a housing which is not shown in the drawings.

Conveniently arranged in the corners of the upper press part 3, four guide columns 4 having circular cross section protrude from the upper press part 3 at the underside thereof. Alternative arrangements of the guide column 4 are readily possible and are predetermined by the size of the press and by the pressing pressure to be applied.

The guide column 4 shown in the drawings is fixed to the underside of the upper press part 3 by screws 5 at one end and, for this purpose, has a flange 7 provided with threaded bore holes 6.

Figure 2:
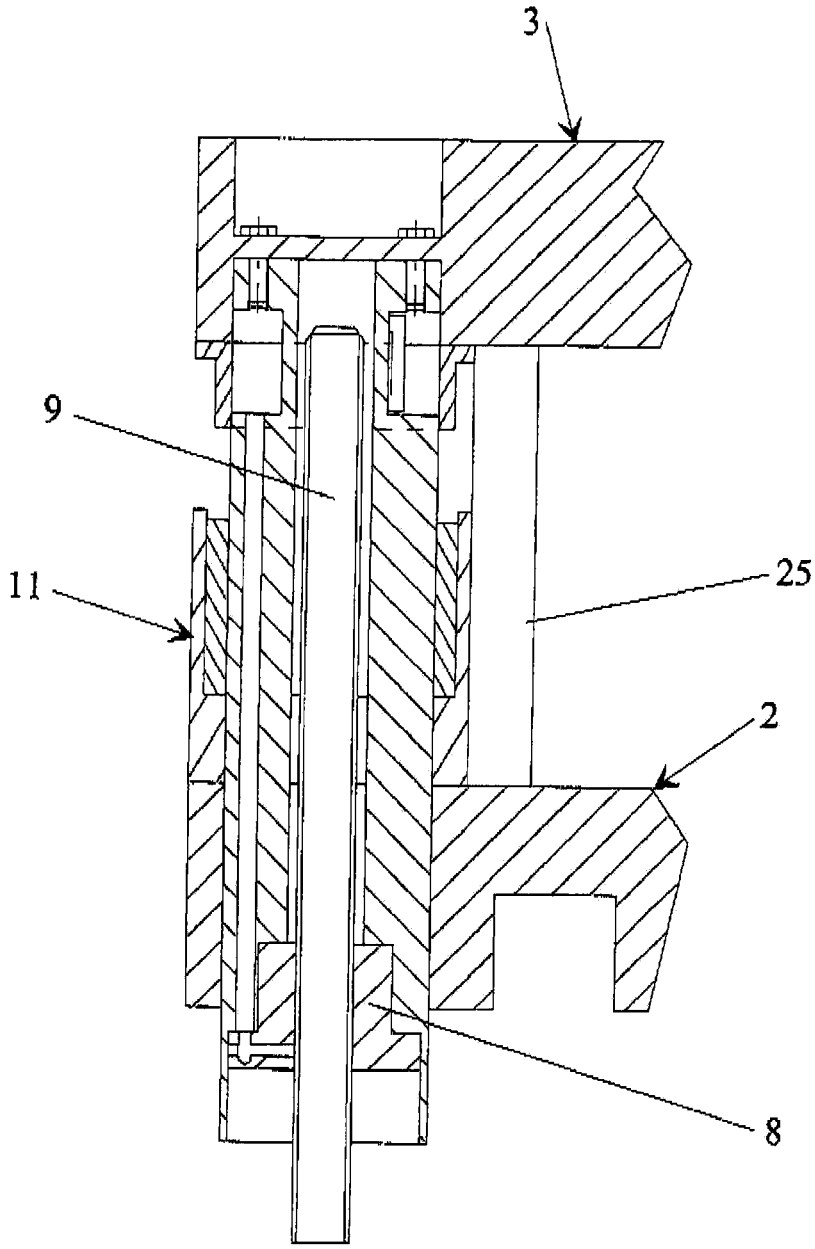
FIG. 2 the section according to FIG. 1 with an upper press part in a lower position.

At the other end, a vertically adjustable spindle nut 8 is fixed to the guide column 4 so that the guide column 4 is loaded in tension during a pressing process in which the upper press part 3 is moved vertically toward the press table 2 (see FIG. 2).

The spindle nut 8 is penetrated by a threaded spindle 9 which is bearing-supported at the underside of the press table 2, where it can be set in rotation by a drive, not shown. For synchronous running of a plurality of threaded spindles, an electrical or mechanical coupling is carried out in a manner known per se.

When the upper press part 3 is lowered toward the press table 2, the threaded spindle 9 is received by an axial core bore hole 10 in the guide column 4. Correspondingly, the dimensioning of the diameter of the core bore hole 10 must be sufficiently large. Further, the axial length of the guide column 4 must be dimensioned so as to be greater than the stroke of the screw press 1 so as to ensure that the threaded spindle 9 can also penetrate into the core bore hole 10 (see FIG. 2) in the lowest position of the upper press part 3.

In the illustrated embodiment example, the guide column 4 has a circular cross section, and the core bore hole 10, spindle nut 8 and threaded spindle 9 are arranged coaxially relative to one another.

Further, the circular cross section of the guide column has the advantage that the guide column 4 can be guided comparatively easily into a plain bearing, for example, with a receptacle 11 for a bushing 12 which is arranged in this instance directly on the press table 2.

Corresponding to the outer diameter of the guide column 4, the press table 2 is provided below the plain bearing 11 with a recess 13 into which the guide column 4 can penetrate in the lowered position of the upper press part 3.

The spindle nut 8 is fixed in a bore hole 14 having a greater diameter than the core bore hole 10. In the embodiment example, the spindle nut 8 further has a radially projecting collar 15 which is received in a precisely fitting manner in a further coaxial bore hole 16 in the guide column 4 so that the spindle nut 8 with collar 15 is arranged in its entirety inside the guide column 4. Consequently, there is no damage to the outer surface 17 of the guide column 4.

For lubrication of the spindle nut 8 on the threaded spindle 9, an axial lubrication bore 18 is arranged in the guide column 4, which also leaves the outer surface 17 intact. The lubrication bore 18 continues axially in a blind bore hole 19 in the spindle nut which is crossed by a radial lubrication bore 20 in the collar 15. The latter is closed radially outwardly, for example, by a set screw 21 so that a lubricant can be guided to the thread of the spindle nut 8 and threaded spindle 9 via these bore holes 18, 19, 20 using a lubricating nipple, not shown.

The drawing further shows that the guide column 4 is connected by screws 5 to the upper press part 3. The flange 7 with threaded bore holes 6 which is provided for this purpose is formed by an annular groove 22. The axial length of this annular groove 22 is so dimensioned that a force transducer 23, in this case a strain gauge, can measure the axial tensile loading of the guide column 4. The annular groove 22 with force transducer 23 is covered by a sleeve 24. The electrical connection of a force transducer 23 of this kind is effected by means of a cable, not shown in the drawing, which can be guided in a telescopic cable conduit 25, for example.

The invention claimed is:

1. A screw press comprising:

a drive (26);

a guide column (4);

a threaded spindle (9) within said guide column (4);

a spindle nut (8) vertically adjustable at said threaded spindle (9);

an upper press part (3) having an underside;

said guide column (4) connected to said underside of said upper press part (3); and wherein said guide column (4) is loaded in tension by said drive (26) during a pressing process, wherein said guide column (4) comprises an outer annular groove (22) on the upper press part side, and additionally comprising a force transducer (23) arranged in said annular groove (22).

2. The screw press according to claim 1, wherein said threaded spindle has a diameter and said screw press has a stroke; and wherein said guide column (4) comprises an axial length and a central core bore hole (10) having a diameter greater than said diameter of said threaded spindle (9); said axial length of said guide column (4) corresponding at least to said stroke of said screw press; and said spindle nut (8) penetrated by said spindle and fixed at a distal end of said guide column (4) opposite said upper press part (3) coaxial to said core bore hole (10).

3. The screw press according to claim 1, additionally comprising a guide (11) at a press table (2) for guiding said guide column (4).

4. The screw press according to claim 3, wherein said guide (11) on the press table (2) is a plain bearing (11).

5. The screw press according to claim 2, wherein said spindle nut (8) is fixed in a further bore hole (14) at the distal end of the guide column (4).

6. The screw press according to claim 5, wherein said spindle nut (8) comprises a radially projecting collar (15).

7. The screw press according to claim 1, wherein said spindle nut (8) is arranged in its entirety inside said guide column (4).

8. The screw press according to claim 1, wherein said guide column (4) has an axial lubrication bore (18), and the spindle nut (8) has a radial lubrication bore (20) and a blind bore hole (19) axially adjoining said axial lubrication bore (18); and said axial blind bore hole (19) being crossed by said radial lubrication bore (20) in said spindle nut (8).

9. The screw press according to claim 1, additionally comprising a flange (7) formed by said annular groove (22) for fixing said guide column (4) to said upper press part (3).

* * * * *